United States Patent [19]

Jorgensen et al.

[11] 4,369,760

[45] Jan. 25, 1983

[54] PORTABLE OVEN AIR CIRCULATOR

[75] Inventors: Jorgen A. Jorgensen, Bloomington; Donald W. Nygren, Minneapolis, both of Minn.

[73] Assignee: Northland Aluminum Products, Inc., Minneapolis, Minn.

[21] Appl. No.: 189,661

[22] Filed: Sep. 22, 1980

[51] Int. Cl.[3] ..... D24C 15/32; A21B 1/00

[52] U.S. Cl. ..... 126/21 A; 99/447

[58] Field of Search ..... 126/21 A; 185/39, 40 F; 99/447

[56] References Cited

U.S. PATENT DOCUMENTS

| | | | |
|---|---|---|---|
| 280,824 | 7/1883 | Holt | 185/40 F |
| 1,861,066 | 5/1932 | Rees | 185/40 M |
| 4,226,178 | 10/1980 | Geissler et al. | 126/21 A |
| 4,283,614 | 8/1981 | Tanaka et al. | 126/21 A |

*Primary Examiner*—James C. Yeung

*Attorney, Agent, or Firm*—Michael E. Kiteck, Jr.

[57] ABSTRACT

A portable air circulating apparatus for use in cooking ovens which is used to create air currents in the oven which transfer heat to cooking foodstuffs to promote more rapid and more uniform cooking or baking, the apparatus including a motor, fan blade and housing of metallic materials selected from a class of heat resistant materials.

3 Claims, 4 Drawing Figures

41
40
20
60
50
32
65
55
G
30
31
35
45
70

41
60
40
55
65
30
G
70

PORTABLE OVEN AIR CIRCULATOR

BACKGROND OF THE INVENTION

It has long been recognized that the heating of materials within an oven enclosure will be more uniform and rapid if a forced ventilation system is employed rather than relying on air currents induced by temperature differences. More recently this concept has been employed in cooking ovens.

Early recognition of this concept is found in U.S. Pat. NO. 2,412,103 to Spooner and U.S. Pat. No. 2,957,067 to Scofield.

The importance of uniform heat to cooking and to baking in particular is known to anyone who has seen cookies burn on one shelf in an oven but not on another, or seen the items in the middle of a pan burn, or observed other effects indicating uneven heating at various locations within an oven. With the onset of energy problems and rising leisure expectations in the modern era, shorter cooking time and lesser energy consumption became more important factors.

Recently others have invented structures designed for cooking or baking ovens and stove ovens. Examples are U.S. Pat. Nos. 3,168,642 to Savio and 3,812,837 to Tadayoshi disclosing structures to increase the rate and uniformity of cooking and baking within the oven.

In an oven without an air handling device to force an air current, air circulates by means of temperature differences in the oven with currents of warmed air rising and cooler air sinking. These currents may not be uniform within the oven, and may change as pans and trays are added. These currents cannot exist without parts of the oven being hotter than others. Also, air is a fairly poor heat conductor and thermal currents move it only slowly so that heat transfer to the cooking food is a slow process.

While the aforementioned patents do disclose ovens with forced air circulation mechanisms for producing air currents within an oven, they are built into the oven itself thus allowing the driving motor to be disposed outside of the oven interior. These structures are accordingly expensive and are not adapted for use with ovens not so equipped by the original manufacturer.

It is accordingly desirable that an oven air circulator be provided in the way of a portable accessory that can be used only when necessary or desirable and which may be located where there is room within an oven and so as to produce optimal circulation in the cooking oven.

SUMMARY OF THE INVENTION

A primary object of the present invention is to provide a self-enclosed and motorized oven air circulator which may be energized and placed within an oven to serve to produce a mechanically forced air current in the oven during the cooking process.

Another object of the invention is to provide a portable oven air circulator which may be used in cooking ovens at all normally used cooking, baking and roasting temperatures.

Still another object of the invention is to provide a portable oven air circulator for use in cooking ovens which is durable, economical to manufacture and relatively easy to operate, keep clean and store.

Yet another object of the invention is to provide a portable oven air circulator for use in cooking ovens to circulate the air in such a fashion to produce relatively uniform and rapid cooking.

With these and other objects in view the invention broadly comprises a portable oven air circulator having a compact housing, a motor mounted within the housing, means for energizing the motor, a fan blade, a fan guard, drive means acting between the motor and fan blade whereby as the motor is energized the fan blade will be rotated, and a base with means for attachment to an oven shelf.

DESCRIPTION OF THE PREFERRED EMBODIMENT

Figure 1:
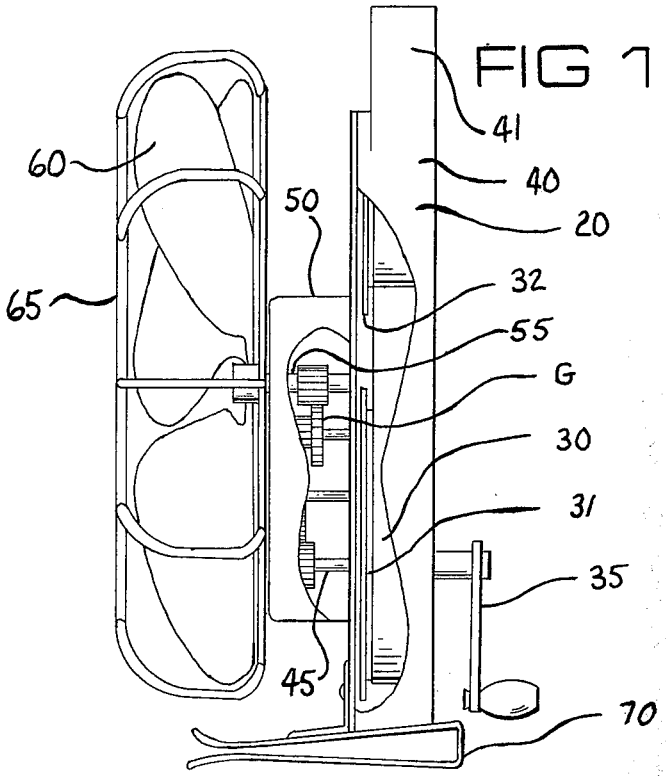
FIG. 1 is a side elevation of the oven air circulator with the housing partially cut away to show the motor and drive means.

Referring now more particularly to the drawings reference numerals will be used to denote like parts or structural features in the different views. The numeral 10 denotes generally a conventional oven of boxlike configuration with hinged front door 12. The oven shelf upon which the heat circulator unit is attached is shown at 15 in FIGS. 3 and 4 and a container C is shown positioned on the shelf 15 within the oven and containing food F to be cooked.

The air circulator unit itself forming the subject of the present invention is designated generally by the numeral 20. It stands in a generally vertical orientation so as to occupy little space. The construction thereof will best be understood by reference to FIGS. 1 and 2.

Figure 2:
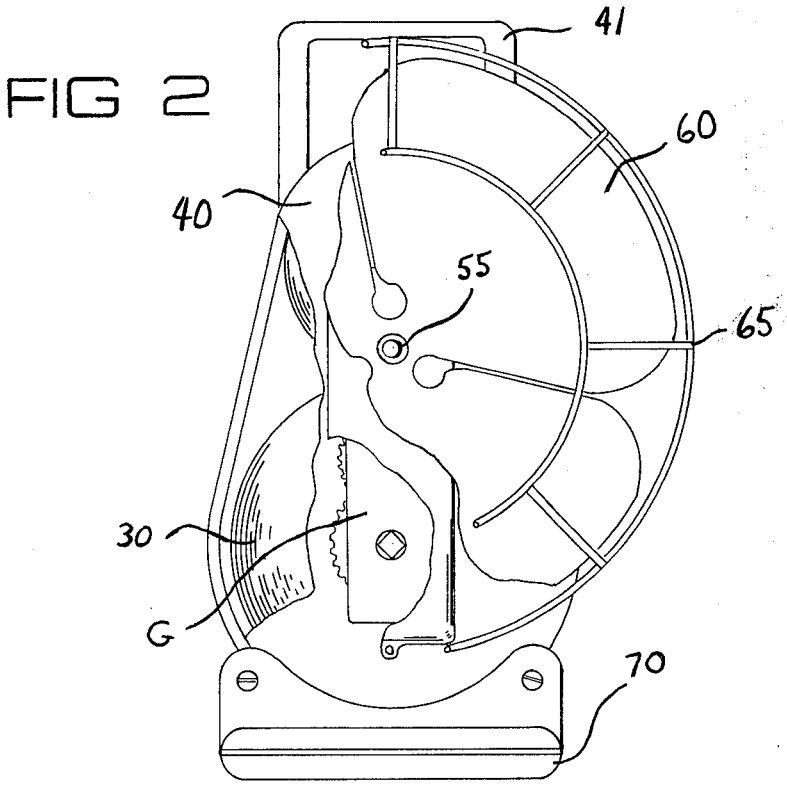
FIG. 2 is a front elevation of the oven air circulator with the housing partially cut away to show the motor and drive means.

FIG. 1 shows the elements of the air circulator in side elevation. A long flat metal spring 30 is wound about a power reel 31 and an idler reel 32. A crank 35 attaches to the power reel 31 to wind the spring 30 onto the power reel 31. When freed, the spring 30 will wind off the power reel 31 and onto the idler reel 32 turning the power reel 31. A spring case 40 with integral handle 41 encloses the spring 30 and both reels. Holes allow entrance of the crank 35 and a shaft 45 attached to the power reel 31. This shaft 45 connects to a gear reduction train generally designated as G. The gear train G is enclosed in a gear case 50. A hole through gear case 50 allows a shaft 55 to protrude, which shaft 55 is driven at reduced speed by the gear train G. Upon the shaft 55 is mounted a fan blade 60 which is enclosed within a protective fan guard 65. At the bottom of the spring case 40 is attached an oven rack clamp 70 which is oriented in a horizontal plane and also serves as a base or stand for supporting the air circulator on horizontal surfaces.

All of the elements of the air circulator are fabricated of heat resistant metal or other heat resistant materials suitable for operation through the range of temperatures encountered in an oven during cooking, baking, roasting, broiling and related cooking operations.

Figure 3:
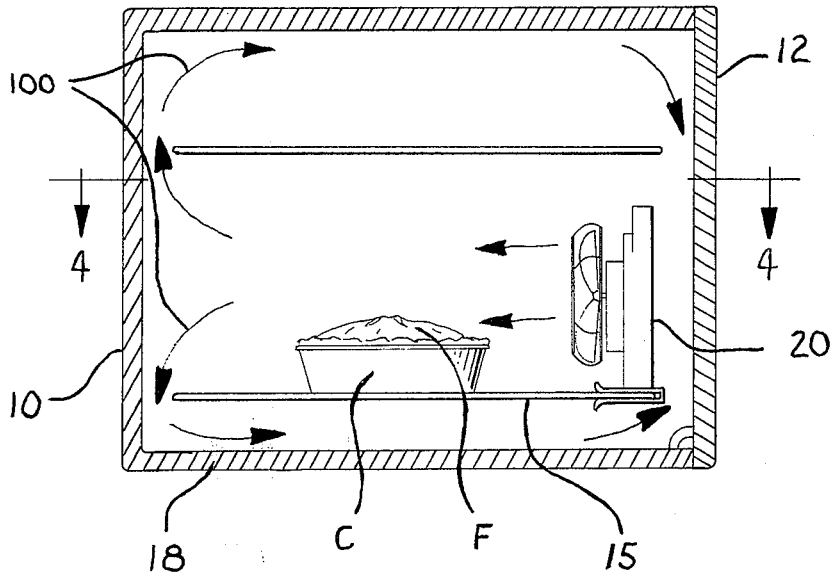
FIG. 3 is a cutaway side view of a conventional oven with food being cooked and showing the portable oven air circulator positioned at the front of the oven attached to the front of an oven shelf and showing the attachment of the circulator onto the oven shelf by the base bracket.
Figure 4:
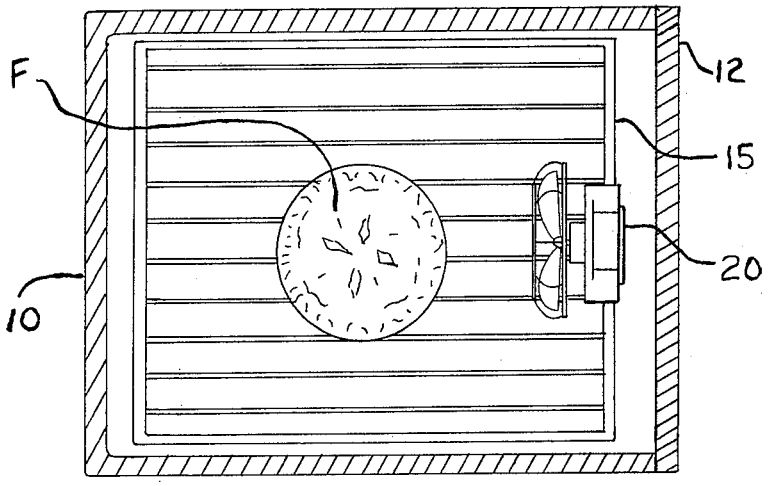
FIG. 4 is a horizontal section through the oven taken on line 4—4 of FIG. 3, but showing the food and portable oven air circulator in top view.

FIGS. 3 and 4 show the air circulator 20 attached to an oven rack 15 within an oven 10. The cooking food F is shown in a container C upon the oven rack 15. The forced air circulation generated by the air circulator is indicated by the arrows 100. As the air passes over the heated surfaces of the oven such as gas burners or electric heating elements (not shown) and nearby oven structures such as the bottom 18 of the oven, the air is warmed. As this warmed air is circulated over the surface of the cooking food, it heats the food. This results in faster cooking with reduced cooking time and lesser energy consumption than would be the case without forced air circulation. In addition, the heat is more evenly distributed by the mechanically forced air circulation for more even cooking. In the absence of mechanically forced air circulation radiant heat from the warm bottom 18 of the oven 10 contributes to heating the food, but much of the heat is conducted by moving air. The only force moving the air is temperature differences. The hotter parts such as the burner or heat element and the bottom 18 of the oven 10 heat nearby air which rises displacing cooler air downward. This type of circulation is slow and there must be substantial temperature differences to cause any appreciable circulation. These temperature differences result in hot spots and cold spots which cause uneven cooking. In addition, since there must be a substantial temperature difference, the burner or heat element must be maintained at a higher temperature to achieve a given food temperature. Also, since the air circulation is slow, a longer cooking time will be required.

The oven air circulator 20 is compact and stands at one end of the oven 10 so that most of the oven area may be used for cooking. It imparts a circulation 100 in a horizontal direction across the surfaces of the cooking food F, which cools the air, so that the air returning from the food along the oven surfaces and in particular over the oven bottom 18 picks up heat and is warmed. The rate of flow is enough that the temperature difference is minimized so that a lower temperature of the heating element or burner will produce the same level of heating of the food.

While we have shown and described an embodiment of this invention in some detail, it will be understood that this description and illustrations are offered merely by way of example, and that the invention is to be limited in scope only by the appended claims.

Having disclosed and described a preferred embodiment of the invention, what we claim to be new and desire to protect by United States Letters Patent is:

1. A compact portable air circulator for use in a cooking oven to increase the rate and uniformity of cooking and baking which comprises:

(a) a fan blade of heat resistant material, (b) a metal housing, (c) a gear reduction train within the housing connected to the fan blade, (d) a spring motor within the housing connected to the gear reduction train to drive the fan, and (e) a large flat horizontal oven rack clamp for positive engagement with a wire oven rack and which clamp also serves as a base for the air circulator so that it might stand upon a horizontal surface in said oven.

2. The subject matter of claim 1 which further comprises a fan guard to protect the fan blade from impact with other objects and likewise to protect the other objects.

3. The subject matter of claim 1 wherein the fan and motor are of metal.

* * * * *